US006347763B1

(12) United States Patent
Harkins et al.

(10) Patent No.: US 6,347,763 B1
(45) Date of Patent: Feb. 19, 2002

(54) SYSTEM AND METHOD FOR REDUCING DISPERSION OF SMALL ROCKETS

(75) Inventors: Thomas E. Harkins, Joppa; T. Gordon Brown, Abingdon, both of MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/751,925

(22) Filed: Jan. 2, 2000

Related U.S. Application Data

(60) Provisional application No. 60/199,416, filed on Apr. 24, 2000.

(51) Int. Cl.[7] ..... F42B 10/02; F42B 15/01

(52) U.S. Cl. ..... 244/3.21; 244/3.15

(58) Field of Search ..... 244/3.1, 3.15, 244/3.21, 3.22, 3.23

(56) References Cited

U.S. PATENT DOCUMENTS

| | | | | |
|---|---|---|---|---|
| 3,603,532 A | * | 9/1971 | Harms | 244/3.21 |
| 5,035,376 A | * | 7/1991 | Voigt et al. | 244/3.21 |
| 5,129,604 A | * | 7/1992 | Bagley | 244/3.22 |
| 5,259,569 A | * | 11/1993 | Waymeyer et al. | 244/3.22 |

* cited by examiner

*Primary Examiner*—Bernarr E. Gregory
(74) *Attorney, Agent, or Firm*—Paul S. Clohan, Jr.; William V. Adams

(57) ABSTRACT

An active damping method and a self-contained active damping system that can be retrofitted to existing rockets are provided which for reducing the dispersion of rockets by using lateral thrusters to oppose any initial yawing motion. The self-contained system of the present invention can be installed in a cylindrical section of a rocket body by insertion between other flight body parts.

10 Claims, 4 Drawing Sheets

SYSTEM AND METHOD FOR REDUCING DISPERSION OF SMALL ROCKETS

This application is related to U.S. Provisional Application No. 60/199,416, filed Apr. 24, 2000.

BACKGROUND OF THE INVENTION

1. Field of the Invention

The present invention relates to the field of rocket-launched projectiles. More particularly, the invention is directed to a system and method for reducing the dispersion of rockets by using lateral thrusters to oppose any initial yawing motion. This system is self-contained and can be retrofitted to existing unguided rocket systems.

2. Description of Related Art

It is well known in the art that rocket-launched projectiles are subject to delivery inaccuracies. Factors contributing to projectile delivery inaccuracy are usually divided into two categories: mean point of impact (MPI) errors and precision errors. MPI is the average of the impact locations of a group of projectiles fired from a single launcher on a particular occasion. The MPI error captures the variability, over multiple occasions, of the MPI about the aim point. MPI error is also called occasion-to-occasion or mission-to-mission error.

Precision error is the variation of individual round impacts within a volley about the MPI. Precision error is primarily attributable to variances of projectiles and propellants resulting from allowable manufacturing tolerances. Precision error is also called random error or round-to-round dispersion.

Initial yawing rate is the largest contributor to the precision errors of small rockets. These round-to-round initial yawing motions are caused by such things as ballotting-inducing tip-off and variable gravity droop. This angular motion produces yaw during the launch/thrust phase of small rockets' flights. When a rocket is yawed, its thrust vector is not aligned with its velocity vector, causing the rocket to depart from its intended flight path in the direction it is pointing. Integrated over time, this produces a large dispersion error.

Yawing motion during rocket launch and thrust can also result from occasion errors such as meteorological (MET) variations and manufacturing lot variations. Platform characteristics contribute to occasion errors whenever small rockets employ a number of possible launchers mounted on different launch platforms.

For example, rigid ground-based launchers have very different occasion errors than do helicopter-borne launchers. Helicopter-launched rocket trajectories are affected by both the helicopter's motion and by the rotor wake present at the time of launch. The helicopter's motion at the time of rocket launch affects the rocket's trajectory through the addition of the aircraft's motion to the rocket's initial motion. Further, depending on the type of helicopter and maneuver, rotor motion will vary. Instantaneous rotor wakes, i.e., downwash, vary with the rotor's speed and rotational position. The magnitude and direction of downwash at launcher exit will affect the rocket's initial yawing motion.

It is known that yawing motion of rockets can be quickly damped by a technique known as active damping, comprising appropriately timed firings of impulsive lateral thrusters in a direction that opposes the yawing motion. Kershner et al., U.S. Pat. No. 2,995,319, the entire disclosure of which is hereby incorporated by reference, teach a device for controlling roll, pitch, and yaw attitude. This device utilizes four jet reaction nozzles mounted at the rear of a missile, mechanically linked to the rocket's tail fins. Bagley, U.S. Pat. No. 4,967,982, the entire disclosure of which is hereby incorporated by reference, teaches a lateral thruster design to be used for steering and maneuvering missiles during flight. Bagley's device provides continuous lateral forces which are controllable in both magnitude and direction of application. However, both these patents teach providing control forces primarily intended for use in later portions of rocket trajectories rather than during the initial launch stage.

While Kershner and Bagley disclose devices for maintaining a rocket's flight path, neither teaches improving rocket performance/accuracy. Further, neither of these patents is directed to a self-contained device in a configuration that can be retrofitted to existing missile systems. And, neither Kershner nor Bagley discloses an approach that dynamically measures and opposes excessive initial yawing rates in order to reduce the dispersion of rocket-launched projectiles.

SUMMARY OF THE INVENTION

The present invention builds on the technique of active damping to provide a system and method for damping yaw during initial rocket launch. To accomplish active damping during initial flight, the present invention employs a system comprising multiple thrusters, angular rate sensors, and a simple thruster firing circuit that are all contained in a single section that can be installed in a cylindrical section of the rocket body by insertion between other flight body parts.

The method of active damping of the present invention is intended to be completed before the occurrence of first maximum yaw of a rocket's flight thereby reducing rocket dispersion. This method includes monitoring the missile's initial yawing rate at launch, and, if that rate exceeds preset thresholds, firing a lateral thruster in a direction opposed to that yawing motion. This method includes repeating these monitoring and firing steps, as required, for a preset period immediately following launch.

The method of the present invention has been evaluated via simulation of a ground-launched rocket at 25° elevation, without any initial disturbances and flying through a standard atmosphere. In this simulation, when the missile is 2000 m down range it will be at a height of 822 m and will have deflected 0.6 m to the right of the line of fire. For each of 950 simulated flights of rocket launches at 25° elevation, initial yawing rates were randomly drawn from distributions representative of initial rates measured for such rockets. The height and deflection components of the positions of each of these rockets are shown in FIG. 3, where each rocket's position is represented by a dot. The cross hairs indicate the nominal rocket position or aim point. The left axis gives the absolute height and the right axis the height relative to the aim point. Because the deflection component of the aim point is only 0.6 m, a relative deflection location axis was not included as it would be indistinguishable from the absolute deflection location axis. The extent of the rockets' dispersion pattern can be read directly on the bottom and right axes. If these results are thought of in terms of rockets launched at a 2000 m distant aerial target, such as a hovering helicopter, at 822 m height, the graphed locations give the points of closest approach of the rockets to that target. The sample mean is 28 m low and 0.5 m to the right of the aim point and the sample deviations are 34.6 m in height and 30.8 m in deflection.

Another measure of dispersion commonly used within the military is the circular error probable (CEP). CEP is the radius of a circle, usually about the sample mean of the impacts, but also sometimes about the point of aim, which encloses 50 percent of the shots in the sample. The CEP about the sample mean lends itself to a simple graphical representation of both biases and relative dispersions of active damping concepts. The CEP for the shot pattern of the simulated undamped rockets is 32.4 m and is indicated by the circle in FIG. 3.

When the active damping system of the present invention was modeled the shot pattern shown in FIG. 4 resulted. This modeled active damping system has a sample mean 1.8 m above and 0.2 m to the left of the aim point, the sample deviations are 9.1 m in height and 11.5 deflection, and the 50 percent CEP radius is 8.0 m. No sensor errors, thruster initiation variations, or variations in thrust profiles were modeled. For this idealized simulation scenario, active damping virtually eliminated the bias in the mean and reduced the spread of the projectiles by about a factor of four.

DETAILED DESCRIPTION OF THE PREFERRED EMBODIMENTS

Figure 1:
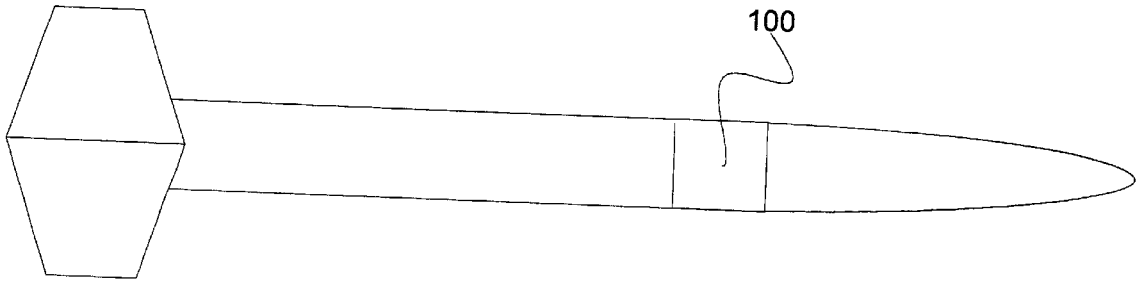
FIG. 1 illustrates an embodiment of the dispersion reducing system of the present invention located in the body of a rocket.

An embodiment of the present invention locates an active damping system 100 in the forward part of a rocket body, as shown in FIG. 1. A consideration for lateral thruster use in an active damping application is the location of the thrusters on the rocket. The effect of the thrusters will vary directly with their distance from the center of gravity (CG) of the combined rocket-damper. Tactical configurations usually have only limited space at predetermined locations available for any additional on-board hardware. For example, on 2.75-inch rockets, an embodiment of the present invention could be placed in a self-contained, disk-shaped section inserted at a distance approximately equal to 6 calibers from the nose of the rocket.

As illustrated in FTC. 2*a*, this system 100 comprises two angular rate sensors 1 and 2, oriented so that the axes about which they measure rotation rates q and r, are both perpendicular to the longitudinal axis of the missile and at the same time perpendicular to each other. In the configuration illustrated in FIG. 2*a*, the sensors 1 and 2 measure the body-fixed components of missile yawing rate q and r, respectively. In this embodiment of the present invention, signals from each sensor 1 and 2 are passed to electronics (not illustrated) that control firing of thrusters 3, 4, 5, 6 illustrated in FIG. 2*a* and 7, 8, 9, 10 illustrated in FIG. 2*b*.

Figure 2A:
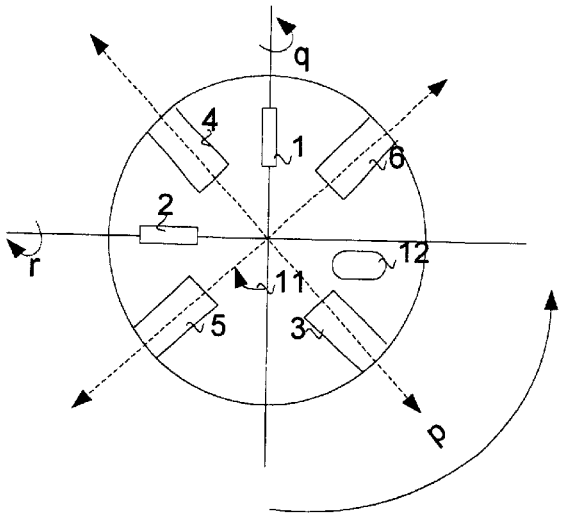
FIG. 2*a* illustrates a view from a rocket nose of a cross-section of a forward thruster ring and rate sensors of an embodiment of the present invention installed in a rocket.
Figure 2B:
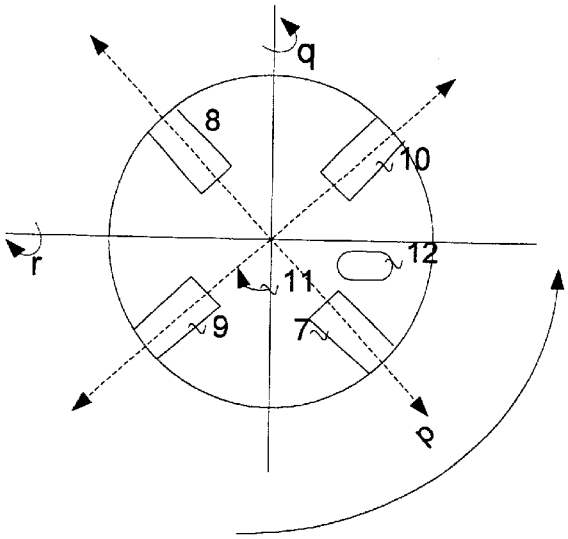
FIG. 2*b* illustrates a view from a rocket nose of a cross-section of an aft thruster ring of an embodiment of the present invention installed in a rocket.
Figure 2C:
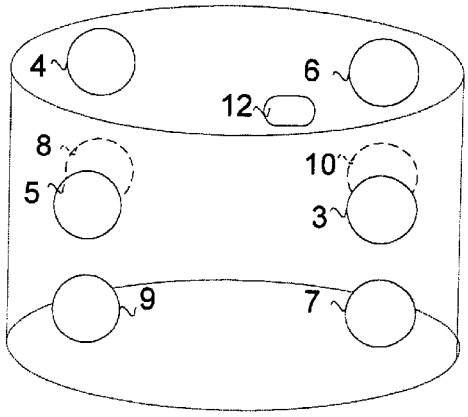
FIG. 2*c* illustrates a side view of both a forward and aft thruster ring installation in a rocket.
Figure 3:
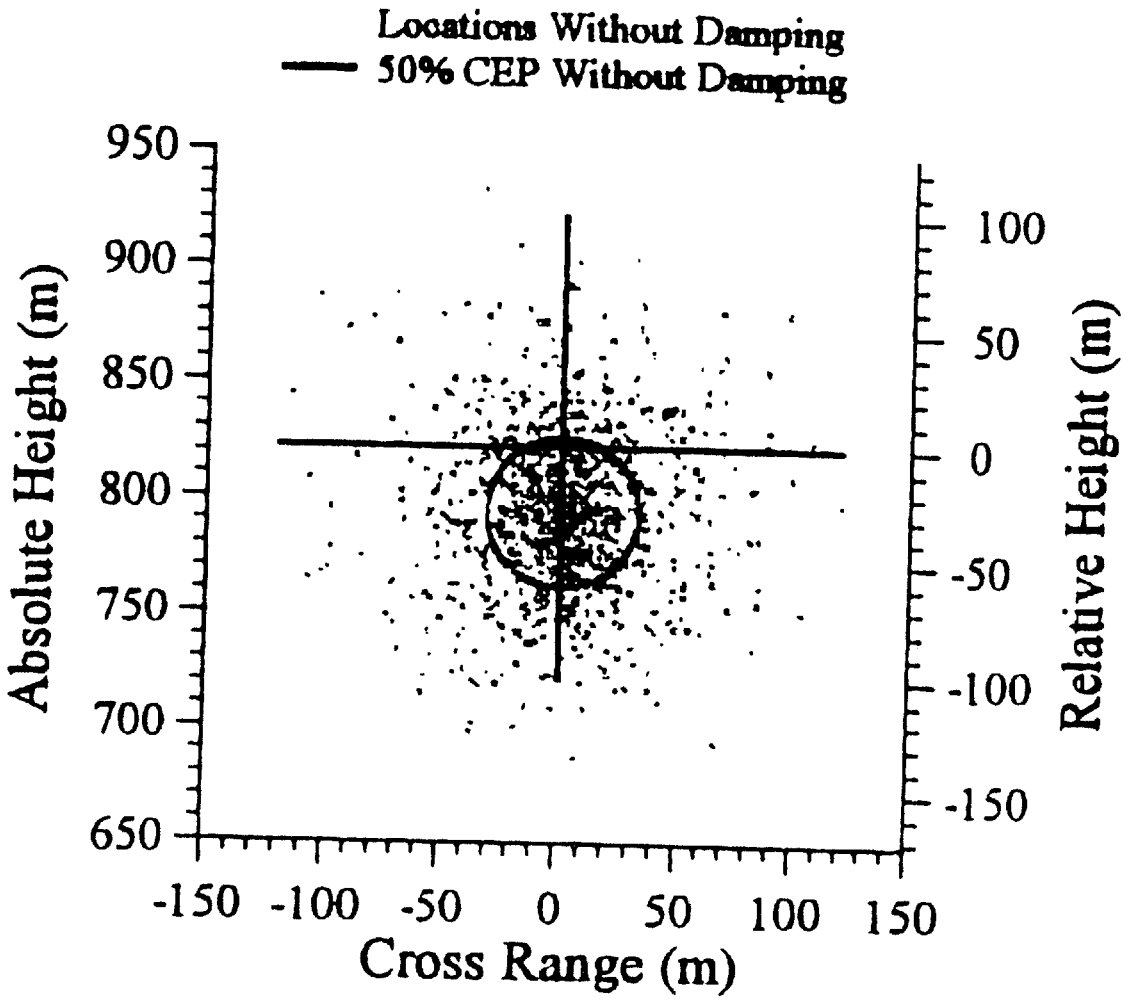
FIG. 3 illustrates rocket dispersion at 2000 m range attributable to initial yawing motion without active damping.
Figure 4:
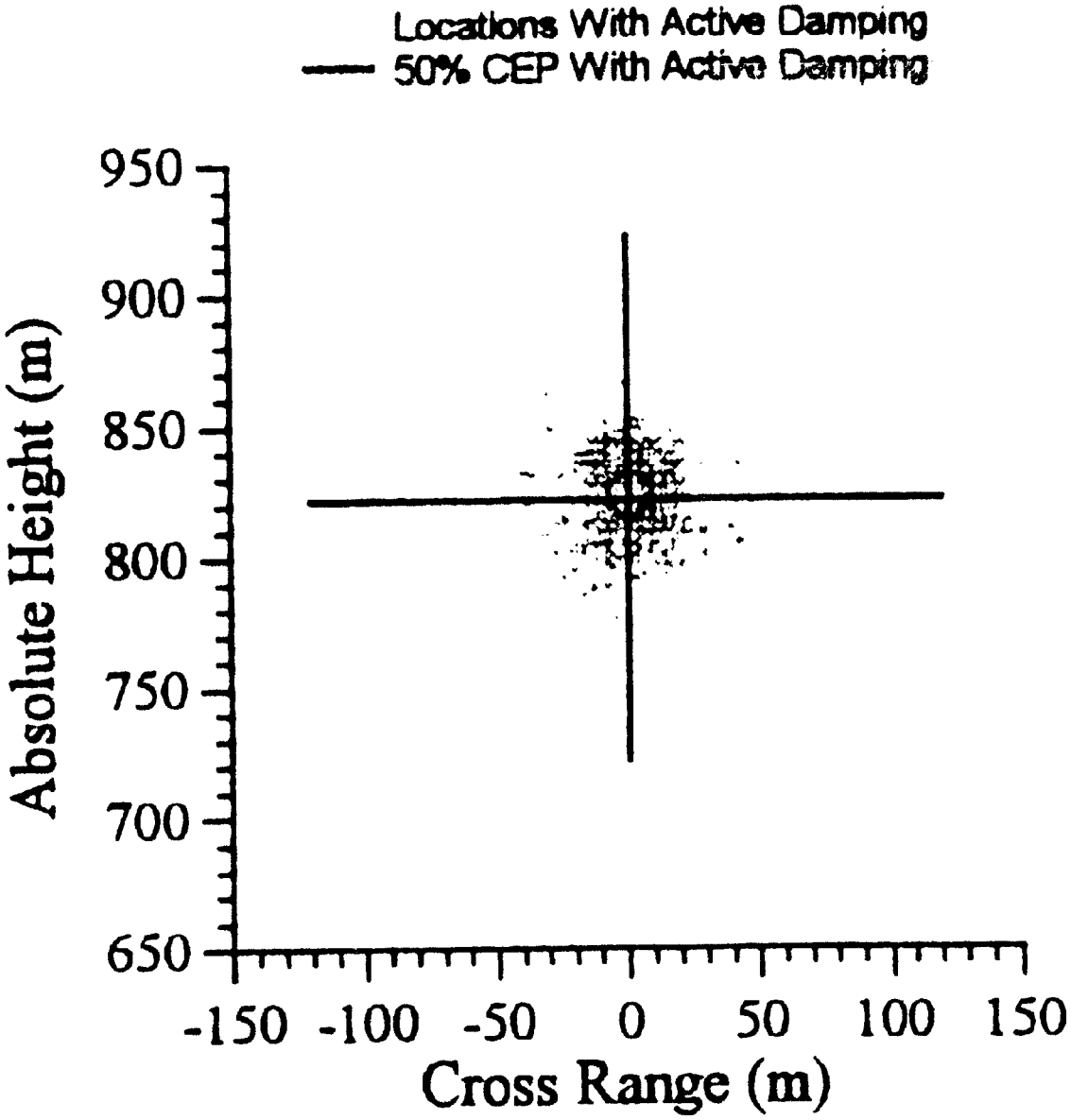
FIG. 4 illustrates rocket dispersion at 2000 m range with active damping according to the present invention.

Referring now to FIG. 2*c*, two sets of four thrusters 3, 4, 5, 6 and 7, 8, 9, 10, each forming a thruster ring, are included in this embodiment. In addition, in this embodiment each individual thruster comprises a propellant-filled right-cylinder with an attached initiator. Each of these thruster rings, shown individually in FIG. 2*a* and FIG. 2*b*, is installed so that the axes of symmetry of their four thrusters are in a common cross-sectional plane and are 90° apart. The thruster rings are oriented such that the angle 11 between the radius along which lies the axis of symmetry of a thruster and the radius along which lies the nearest measurement axis of a rate sensor is tailored to the type of rocket to which the active damping system is being applied. For 2.75" rockets this angle is approximately equal to 15°, measured opposite the direction of missile rotation at launch, as shown in FIG. 2*a*.

In this embodiment, within a ring of thrusters all four of the thrusters are alike, i.e., they have the same size and performance. For example, each of the thrusters in the ring shown in FIG. 2*a* could have a 4 Newton-second impulse and those in the ring shown in FIG. 2*b* could have a I Newton-second impulse.

In one embodiment of the present invention, power is provided for the rate sensors 1 and 2 at launch initiation by a battery. At the same time a capacitor will be charged. This capacitor is to be used for thruster initiation and the time necessary to charge it serves am a post-launch delay before a thruster can be fired and as an inter-firing delay between possible subsequent thruster firings.

A thruster firing will take place when one of the rate sensors' outputs is above a preset threshold, indicating an excessive yawing rate, while at the same time the output of the other sensor is below another much lower threshold, indicating a roll orientation of the missile with respect to the direction of the yawing motion. This thruster firing algorithm can be implemented in a known circuit using several comparators and a logical "AND" circuit. The battery, firing circuit, wiring, and other required electronics 12 are not shown in detail in FIG. 2*a* and FIG. 2*b*, because packaging of these components depends, in part, on the sizes and mass properties of the other components of an active damping device according to the present invention.

In another embodiment of the present invention, greater precision enhancement is achieved by setting the thresholds to be exceeded for the first firing of lateral thrusters lower than the thresholds for all subsequent firings. This result follows from the fact that the first firing not only seeks to stop the growth of undesirable yaw, but also to remove the pointing error accumulated prior to the initiation of the first correction. Thereafter, once the capacitor is charged, the rates are checked periodically, e.g., once per millisecond.

In one such embodiment, if one sensor indicates a rate magnitude greater than 0.15 rad/s while the other sensor indicates a rate magnitude of less than 0.05 rad/s, the appropriate 4-Ns thruster is fired. When the capacitor is recharged, the process is repeated each millisecond with required threshold exceedances of 0.3 rad/s and 0.1 rad/s for 4-Ns and 1-Ns thruster initiation, respectively. The rate measured by the other sensor is required to be less than 0.05 rad/s.

By way of illustration only, referring to FIG. 2*a*, if at the first check after launch

| | |
|---|---|
| Sensor 1 | q = 0.40 rad/s |
| Sensor 2 | r = 0.01 rad/s |

then a yawing motion of the projectile about the vertical axis is indicated. In FIG. 2*a* the rocket is emerging from the page and when q>0 this means that the yawing motion is turning the rocket's nose to the right. Since q exceeds the higher of the upper thresholds (0.15 rad/s) and r is below the lower threshold (0.05 rad/s), the 4-Ns thruster 3 opposing this motion is immediately fired. If, instead,

| | |
|---|---|
| Sensor 1 | q = −0.40 rad/s |
| Sensor 2 | r = 0.01 rad/s |

then a yawing motion of the projectile nose to the left is indicated and thruster 4 is fired. In either case, when the capacitor is recharged, the new thresholds apply and the process is repeated.

If an additional thruster firing is called for, but the alignment is such that a previously fired thruster is in the indicated position, the system will wait until the next evaluation cycle and check again. If a 4-Ns thruster firing is indicated and the properly aligned 4-Ns thruster has already been fired, the 1-Ns thruster 7, 8, 9, or 10 in the proper alignment is fired, if available.

Whether yawing motion is adding to delivery errors or reducing them can only be known with certainty for the first quarter cycle of initial yawing motion. Therefore, after first maximum yaw (i.e., the first quarter of the first yaw period), active damping is terminated. This assures that damping thrusters are fired during those portions of the yawing cycle when the yawing motion is in the direction of growth of angle of attack. Without additional data from other sources, knowledge of the instantaneous values of q and r only assures that yawing motion is taking place and not whether that motion is adding to or reducing delivery errors. Typically, this cut off will be implemented as a time limit based on a priori knowledge of the typical yawing frequency of the rocket.

From the foregoing it will be obvious to one skilled in the art that numerous modifications and variations can be made without departing from the spirit and scope of the novel aspects of the current invention. For example, the number, sizes, and orientations of thrusters and/or the rate thresholds for initiating thrusters are to be tailored for use on individual rocket projectiles. However, the system and method of the present invention will be the same in spirit and scope for each such embodiment. It is to be understood that no limitation with respect to the specific embodiments illustrated is intended or should be inferred.

What is claimed is:

1. A method for reducing dispersion of a missile launched into a trajectory toward a desired target, said launched missile having an initial yawing rate, at least one preset threshold condition for said initial yawing rate, and at least one lateral thruster, said method comprising the steps of:

(a) launching the missile into said trajectory;

(b) measuring the launched missile's initial yawing rate;

(c) determining if said measured yawing rate exceeds said preset threshold condition;

(d) selecting a lateral thruster to oppose the measured yawing rate;

(e) firing the selected lateral thruster; and (f) repeating steps (b)–(e) for a preset period immediately after launch.

2. A method for reducing dispersion of a missile launched into a trajectory toward a desired target, said launched missile having a missile type, a longitudinal axis, a direction of rotation at launch, an initial yaw period after launch, an initial yawing rate with body-fixed components q and r with respect to said longitudinal axis while in said trajectory, at least two angular rate sensors having measurement axes with respect to said longitudinal axis to measure said body-fixed components, a preset angle for said sensors, at least one preset threshold condition for each body-fixed component q and r, and at least one forward and one aft thruster ring, each said ring having a radius and at least four impulsive fixed-thrust lateral thrusters, each said thruster having an axis of symmetry and installed on said missile oriented radially outward from said longitudinal axis, said method comprising the steps of:

(a) launching the missile into said trajectory;

(b) measuring the launched missile's initial yawing rate components q and r with said angular rate sensors;

(c) determining if said measured yawing rate components q and r exceed said preset threshold conditions;

(d) selecting a thruster ring based on determined threshold exceedances for both q and r;

(e) selecting a thruster in the selected thruster ring that is properly aligned to oppose the measured yawing component q;

(f) firing the selected thruster using a power source;

(g) waiting one measurement period if step (f) did not fire a thruster; and (h) repeating steps (b)–(g) for a preset period immediately after launch.

3. The method of claim 2, wherein:

said angular sensors are oriented so that their measurement axes are perpendicular to each other and to said longitudinal axis;

said threshold conditions are said component q is above a preset threshold Q while at the same time said component r is below another preset threshold R;

said thruster-ring thrusters are four alike thrusters oriented so that their axes of symmetry are in a common cross-sectional plane, said thrusters are 90° apart, and the angle between the radius along which lies an axis of symmetry of a thruster and the radius along which lies the nearest measurement axis of an angular rate sensor is set to said preset angle when measured opposite the direction of missile rotation at launch;

said selected thruster is a previously unfired thruster; and said preset period is the initial yaw period after launch.

4. The method according to claim 3, wherein:

said thrusters in at least one said thruster ring each have a 4 Newton-second impulse and said thrusters in at least one other said thruster ring each have a 1 Newton-second impulse;

said threshold conditions are an initial condition of Q=0.15 rad/s for said 4-Ns thruster ring, Q=0.05 rad/s for said 1-Ns thruster ring, and R=0.05 rad/s, and a subsequent condition, after the first thruster firing, of Q=0.3 rad/s for said 4-Ns thruster ring, Q=0.1 rad/s for said 1-Ns thruster ring, and R=0.05 rad/s; and said selected thruster is the corresponding thruster in the 1-Ns thruster ring if the selected thruster in the 4-Ns thruster ring has already been fired.

5. The method according to claim 2, wherein:

said power source is a capacitor charged by a battery at launch initiation and thereafter when said capacitor is discharged to fire one of said thrusters.

6. The method according to claim 2, wherein:

said missile type is a 2.75-inch rocket;

said preset angle is approximately equal to 15°; and said sensors, thruster rings, and thrusters are placed in a self-contained disk-shaped section inserted at a distance approximately equal to 6 calibers from the nose of the rocket.

7. A system for reducing dispersion of an airborne missile incorporated into said missile, said system comprising;

(a) an airborne missile for being launched toward a desired target and having
(i) a longitudinal axis,
(ii) a trajectory at launch,
(iii) a direction of rotation at launch,
(iv) an initial yawing rate at launch with body-fixed components q and r with respect to said longitudinal axis, and
(v) an initial yaw period after launch;

(b) at least two angular rate sensors for measuring said body-fixed components q and r of said initial yawing rate, said angular rate sensors having measurement axes oriented perpendicular to the longitudinal axis of said missile and at the same time perpendicular to each other;

(c) at least one preset threshold Q for component q and one preset threshold R for component r;

(d) at least one forward and one aft thruster ring each ring having a radius and at least four impulsive fixed-thrust thrusters, each said thruster having an axis of symmetry oriented radially outward from said longitudinal axis; and (e) control means, responsive during a preset period immediately after launch to measurements q and r from said sensors, for firing a previously unfired one of said thrusters contained in one of said thruster rings to oppose said yaw component q when said component q is above said preset threshold Q and said component r is below said preset threshold R.

8. The system of claim 7, wherein:

said missile is a 2.75 inch rocket;

said system is incorporated in a self-contained disk-shaped section inserted approximately 6 calibers from the nose.

9. The system of claim 8, wherein:

said preset period since launch is said initial yaw period after launch;

said thruster ring thrusters are four alike thrusters installed so that the axes of symmetry of the four thrusters are in a common cross-sectional plane and are 90° apart and oriented such that the angle between the radius along which lies the axis of symmetry of a thruster and the radius along which lies the nearest measurement axis of a rate sensor is approximately equal to 15° when measured opposite the direction of missile rotation at launch.

10. The system of claim 9, wherein:

said thrusters in at least one said thruster ring each have a 4 Newton-second impulse and said thrusters in at least one other said thruster ring each have a 1 Newton-second impulse;

said preset threshold conditions are
(i) an initial condition of Q=0.15 rad/s for said 4-Ns thruster ring, Q=0.05 rad/s for said 1-Ns thruster ring, and R=0.005 rad/s, and
(ii) a subsequent condition, after the first thruster firing, of Q=0.3 rad/s for said 4-Ns thruster ring, Q=0.1 rad/s for said 1-Ns thruster ring, and R=0.05 rad/s; and said fired thruster is the properly oriented unfired thruster in the 1-Ns thruster ring if the selected thruster in the 4-Ns thruster ring has already been fired.

* * * * *